United States Patent [19]

Powell

[11] 4,114,238

[45] Sep. 19, 1978

[54] HINGE FOR JEWELRY AND THE LIKE

[75] Inventor: Robert George Powell, Warley, Great Britain

[73] Assignee: Harman Brother Limited, Birmingham, England

[21] Appl. No.: 786,992

[22] Filed: Apr. 13, 1977

[30] Foreign Application Priority Data

May 12, 1976 [GB] United Kingdom ..... 19509/76

[51] Int. Cl.[2] ..... E05D 5/02

[52] U.S. Cl. ..... 16/157; 16/128 R; 29/11; 220/334

[58] Field of Search ..... 16/157, 128 R, 128; 29/11; 220/334, 335

[56] References Cited

U.S. PATENT DOCUMENTS

| | | | |
|---|---|---|---|
| 486,104 | 11/1892 | Harris | 16/157 |
| 625,443 | 5/1899 | Glover | 29/11 |
| 864,088 | 8/1907 | Farrington | 16/128 R |
| 1,591,815 | 7/1926 | Girdany | 16/128 R |
| 1,609,590 | 12/1926 | Whidden | 16/128 R |
| 1,801,559 | 4/1931 | Kellogg | 16/157 |

FOREIGN PATENT DOCUMENTS

| | | | |
|---|---|---|---|
| 1,168,660 | 10/1969 | United Kingdom | 16/157 |

*Primary Examiner*—James Kee Chi

*Attorney, Agent, or Firm*—Marshall & Yeasting

[57] ABSTRACT

The invention provides a miniature hinge for jewelry and the like, made from metal pressings, by making each leaf of the hinge from two laminations of which one provides the hinge knuckle and the other forms a limit stop.

7 Claims, 13 Drawing Figures

HINGE FOR JEWELRY AND THE LIKE

This invention relates to hinges and its object is to provide an improved design, and methods of manufacturing the same, particularly (but not exclusively) suitable for use with especially small hinges for lockets, patch boxes and like ornamental articles.

In accordance with a first aspect of the present invention, a hinge comprises two leaves each provided with one or more knuckles, each leaf comprising two laminations, one of which is provided with the knuckle or knuckles and the other of which forms a reinforcement and an abutment which serves to limit the extent of angular movement.

In accordance with another aspect of the invention, a method of manufacturing a hinge comprises the steps of forming a single strip of metal into a double layer, to provide a knuckle-bearing-lamination and an abutment-forming lamination respectively, securing the two laminations to an article and subsequently cropping the laminations to a desired size.

One presently preferred embodiment of the invention will now be more particularly described with reference to the accompanying drawing wherein.

Figure 1:
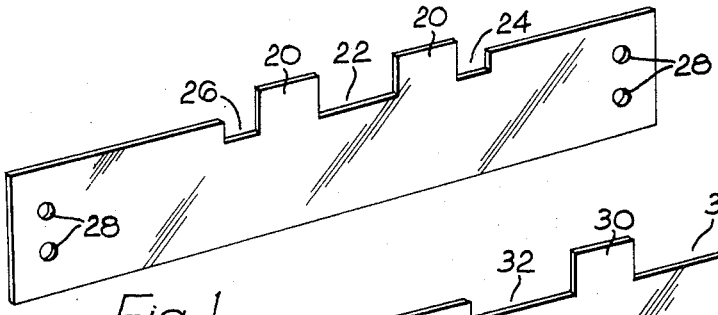
FIG. 1 is a perspective view of a blank for forming a first hinge part.

Referring now to the drawings, the blank FIG. 1 is made from a suitable gauge metal strip or sheet for example by a pressing operation to provide a pair of tongues 20, each of which is to be formed into a hinged knuckle, and which are separated by a gap 22 adapted to receive a hinge knuckle from a second part. The strip is also provided with a pair of gaps 24, 26 located on opposite sides of the tongues 20, and with pairs of holes 28 at each end.

Figure 2:
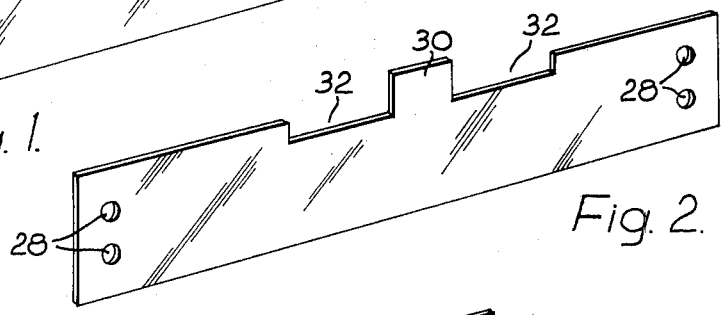
FIG. 2 is a perspective view of a blank similar to FIG. 1 but for forming the second hinge part.

The blank shown in FIG. 2 is generally similar to that in FIG. 1 except that it is provided with only a single tongue 30 which is to provide a knuckle to be received between the knuckles to be formed from the tongues 20 and hence with a pair of wider gaps 32, one on each side of the tongue 30.

Figure 3:
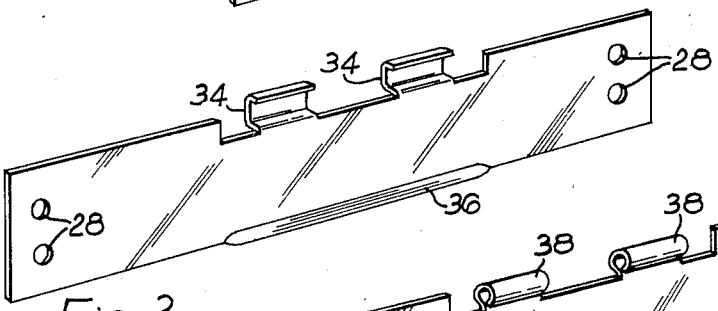
FIGS. 3 to 8 show successive steps in the treatment of the blank of FIG. 1.
Figure 4:
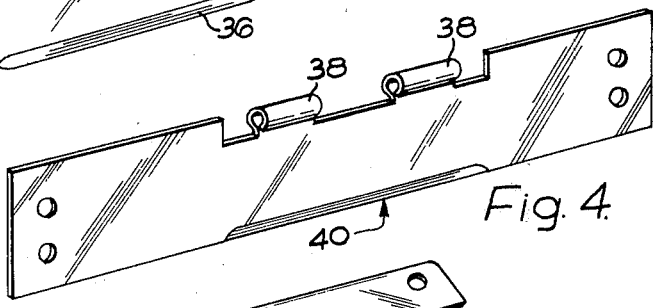

Referring now to FIG. 3, the next operation involves forming the tongues 20 into the channels 34 and at the same time (as a matter of convenience) forming a barrow groove 36 along the opposite edge of the strip. FIG. 4 shows the channels formed into complete knuckles 38 and the opposite edge of the strip trimmed at 40.

Figure 5:
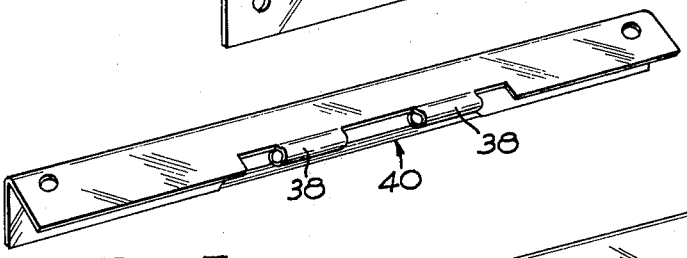
Figure 6:
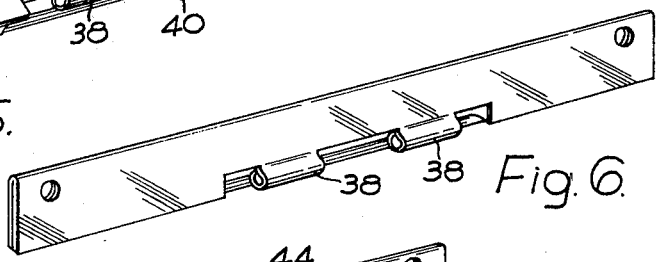
Figure 12:
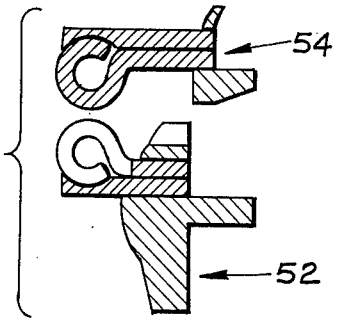
FIG. 12 is a sectional elevation taken on the line 12—12 of FIG. 10 and showing two hinge components secured to their respective parts.
Figure 13:
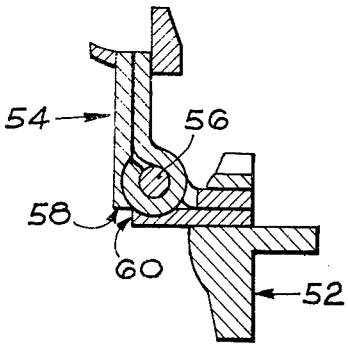
FIG. 13 is a view similar to FIG. 12 showing the completed assembly in one open position.

FIG. 5 shows the strip of FIG. 4 being folded longitudinally, and FIG. 6 shows the folding operation completed when the strip is formed into two laminations, the holes 28 being then aligned. The knuckles 38 then register with the grooves 36, as more clearly seen for example in FIGS. 12 and 13. In this connection it is noted that the knuckles 38, as considered in cross-section, are not symmetrically located with respect to a median plane of the thickness of the strip nor are they wholly asymmetrically located, that is to say a tangent from the exterior of the knuckle would not lie in a plane containing the surface of the strip. The precise arrangement and degree of asymmetry chosen will depend partly on the diameter of the hinge pin utilised, i.e. the internal diameter of the knuckles 38, and will be such that when the two hinge leaves are connected together, so as to complete the hinge, the two leaves may lie in face to face contact. To this end, the knuckle axis is coincident with the plane containing the face of the strip opposite to the face which is grooved at 36, or is spaced parallel to and beyond that face by a desired tolerance.

Figure 7:
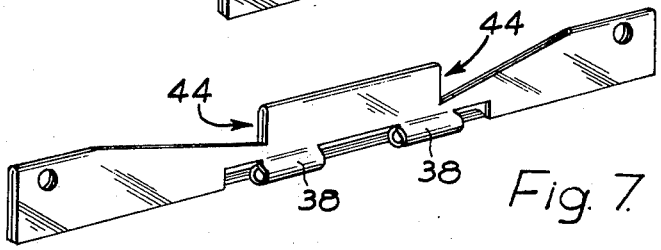
Figure 8:
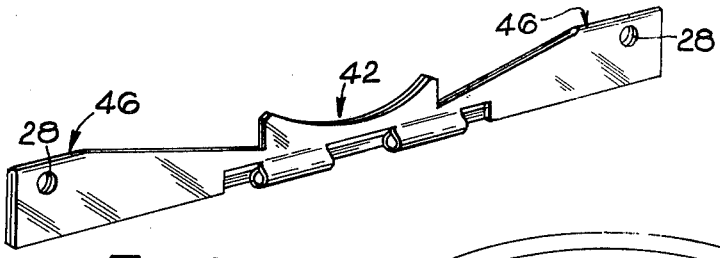

FIG. 7 shows the part in a first cropped condition and FIG. 8 shows a second cropping to cut the concave edge 42 required so that when the hinge is assembled to the ring or bezel, the hinge parts do not project into the interior of the ring so as to become visible. The cropping effected in the operation shown complete in FIG. 7 is to provide the parallel edges 44 to be received within an appropriate slot in the ring part. It will be noted that in the FIG. 8 position, the two laminations are held together only by the metal lying in the areas generally indicated by the reference numerals 46, that is in close proximity to the apertures 28.

Figure 9:
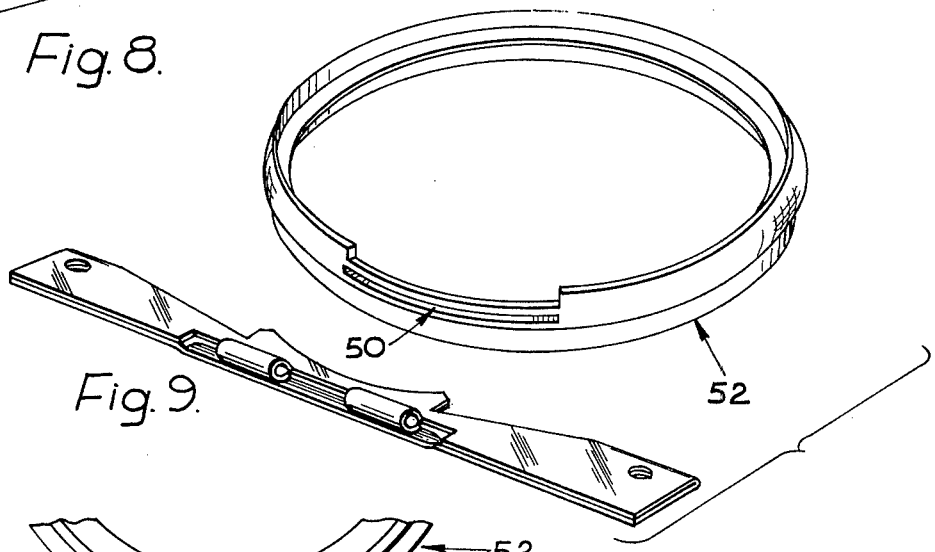
FIG. 9 shows the blank being assembled to a first ring.
Figure 10:
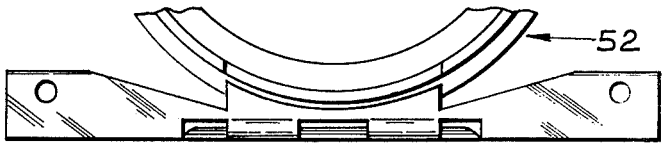
FIG. 10 shows the assembled hinge part and ring in fragmentary plan view.

FIG. 9 shows the part as in FIG. 8 condition being aligned with slot 50 in ring 52. In that assembled position, as indicated in FIG. 10, the part may be soldered, that is sweated, into the ring and this operation secures the two laminations together as well as securing both to the ring. The way is then free for a final cropping operation to take the assembly towards the FIG. 11 condition; preferably the final shaping is a milling operation to avoid crushing the knuckles as might occur in a shearing operation.

It will be appreciated that with appropriate press tools, several of the operations which are described herein as distinct and separate may be carried out at one and the same time. It will also be appreciated that the blank of FIG. 2 is treated in a generally similar manner so as to lead to the hinge part assembled to the ring as generally indicated by the reference numeral 54 FIG. 12.

Figure 11:
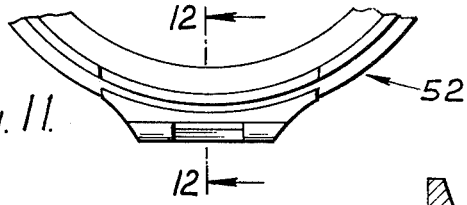
FIG. 11 is a view similar to FIG. 10 and showing a following step of the procedure.

When the two parts, that is the part 54 and the part of FIG. 11 are connected together by the hinge pin 56, the assembly is complete. It will be appreciated that the end edges 58, 60, of the originally grooved part form abutment stops contacting one another when the hinge is in the maximum open position. It will also be appreciated that the sweating operation unites the second lamination over the area of the groove to the periphery of the knuckle, thereby forming a reinforcement for the same.

It will be appreciated that the embodiment described with reference to the drawings utilises two different blanks (FIG. 1 and FIG. 2 respectively) which differ primarily in that the first one (FIG. 1) carries tabs which form a pair of knuckles whereas the second one (FIG. 2) carries only a single tab to form a single knuckle which will be located between the other two when the hinge is assembled. This necessitates two separate and different tools for the production of the blanks, and may indeed necessitate the use of two complete sets of tools for production of the two parts up to the stage where they are assembled together to make the hinge.

However, by appropriate modifications, it is possible to reduce the tools required to only a single set, for example by arranging for a single blank to be made forming a pair of knuckles which are assymmetrically located with respect to the original length of the blank, and so that they are in effect assembled together, one of the two being in reverse relation to the other. This would produce a hinge made up of four knuckles instead of the three shown in the drawings.

For miniature applications, four knuckles may be too many, and the three knuckle version (which may be the minimum for a satisfactory and safe hinge operation) may be preferred, in which event an alternative is possible where the single blank forming a pair of knuckles is utilised and a single set of tools is used up to and including the FIG. 6 stage. However when the part formed hinge leaf is cropped, in the FIG. 7 and subsequent stages, the cropping may be carried out asymmetrically either by the use of separate set of tools, according to whether the treated part manufactured hinge leaf is to be a substitute for the FIG. 1 or the FIG. 2 part, or possibly by the use of only a single set of cropping tools but which are alternately located at different positions relative to the length of the blank, so that although the final hinge has been made from two leaves each comprising a pair of knuckles, only three of the four knuckles are used in the complete hinge, one of them being trimmed off at the FIG. 11 stage.

Other modifications will appear to those skilled in the art.

I claim:

1. A hinge comprising two leaves one provided with at least one hinge knuckle and the other provided with a plurality of hinge knuckles, each leaf comprising two juxtaposed flat laminations reinforcing each other, a lamination of one leaf being provided with said at least one knuckle and a lamination of the other leaf being provided with said plurality of knuckles, and the other laminations each forming an abutment contacting one another edge on edge when the hinge is open.

2. A hinge according to claim 1 wherein the knuckles are located along edges of the respective laminations.

3. A hinge according to claim 2 wherein the other edges of the laminations form said abutments.

4. A hinge according to claim 3 wherein each leaf is a single piece bent into said juxaposed laminations to provide a knuckle-bearing lamination and an abutment-forming lamination.

5. A hinge according to claim 3 wherein the laminations of each leaf are secured together by sweating.

6. A hinge comprising two leaves one provided with at least one hinge knuckle and the other provided with a plurality of hinge knuckles, each leaf comprising two juxtaposed flat laminations of similar shape reinforcing each other, a lamination in each leaf having an edge, the edges by contacting each other limiting hinging movement.

7. A hinge comprising two leaves provided with knuckle means for hinging the leaves, each leaf comprising two laminations with no free edge of which one forms part of the knuckle means and the other forms limit stop means, the stop means on the laminations contacting one another when the hinge is open.

* * * * *